US005863690A

United States Patent [19]

Yamashita

[11] Patent Number: 5,863,690

[45] Date of Patent: Jan. 26, 1999

[54] TONER IMAGE FIXING METHOD

[75] Inventor: Masahide Yamashita, Numazu, Japan

[73] Assignee: Ricoh Company, Ltd., Tokyo, Japan

[21] Appl. No.: 795,970

[22] Filed: Feb. 5, 1997

[30] Foreign Application Priority Data

Feb. 9, 1996 [JP] Japan ..... 8-048387
Jan. 31, 1997 [JP] Japan ..... 9-033015

[51] Int. Cl.[6] ..... G03G 13/20
[52] U.S. Cl. ..... 430/99
[58] Field of Search ..... 430/99, 124

[56] References Cited

U.S. PATENT DOCUMENTS 5,582,917 12/1996 Chen et al. ..... 428/421
5,716,714 2/1998 Chen et al. ..... 428/473.5

FOREIGN PATENT DOCUMENTS 5754968 4/1982 Japan .
582864 1/1983 Japan .
6136778 2/1986 Japan .
61205966 9/1986 Japan .
62168182 7/1987 Japan .
6429882 1/1989 Japan .
4273276 9/1992 Japan .
572934 3/1993 Japan .
5341672 12/1993 Japan .
792851 4/1995 Japan .
9101705 4/1997 Japan .

*Primary Examiner*—John Goodrow
*Attorney, Agent, or Firm*—Cooper & Dunham LLP

[57] ABSTRACT

A toner image fixing method for producing a fixed image having good image qualities without hot-offset even when toner having a relatively low fixing temperature is employed by an image forming apparatus having a fixing unit including two fixing members such that an image formed of thermofusible toner on an image supporting material is fixed by heating at a nipped section of the two fixing members, wherein a ratio of a first adhesion constant to a second adhesion constant, $\mu_{s\text{-}b}$ (1)/$\mu_{s\text{-}b}$ (2), of a surface of a fixing member contacting the thermofusible toner image is less than about 8.0. An adhesion constant $\mu_{s\text{-}b}$ (n) is represented by:

$$\mu_{s\text{-}b}\,(n)=(\cos\theta_b-\cos\theta_s)/\sin\theta_b,$$

wherein n is 1 or 2, $\theta_b$ and $\theta_s$ represent a receding contact angle and a static contact angle of the surface of the fixing member, respectively, which are measured using a liquid having a dipole moment of greater than about 3.0 debye when n is 1 and measured using another liquid having a dipole moment of 0.0 debye when n is 2.

16 Claims, 1 Drawing Sheet

TONER IMAGE FIXING METHOD

BACKGROUND OF THE INVENTION

1. Field of the Invention

The present invention relates to a toner image fixing method for fixing a thermofusible toner image formed by electrophotography, electrostatic recording, electrostatic printing, and the like, and more particularly to a toner image fixing method for fixing a thermofusible toner image which has a relatively low fixing temperature and high tackiness when melted, such that the image is easily and completely fixed without unwanted adhesion to a fixing member of a fixing unit of an image forming apparatus.

2. Discussion of the Background

In an image forming apparatus using electrophotography, an image is generally formed according to the following steps:

(1) an electrostatic latent image is formed on an electrophotoconductor by various methods;

(2) the electrostatic latent image is developed with dry toner;

(3) the developed toner image is transferred to an image supporting material such as paper, for example; and (4) the transferred toner image is fixed by application of heat and pressure to obtain a fixed toner image.

A heat roller fixing method is widely used as a fixing method for fixing a developed image with dry toner (hereinafter referred to as toner) because of the high heating efficiency. In a conventional heat roller fixing unit, a rotating heat fixing roller contacts a developed toner image on an image supporting material and forms a fixed toner image upon application of pressure. Immediately after the toner image on the image supporting material is released from the rotating heat fixing roller, the toner image is melted and tacky. If the releasability of the surface of the heat fixing roller from the toner image is insufficient, so-called "hot offset" occurs in which the melted toner image is transferred to the heat fixing roller and subsequently retransferred to another region on the image supporting material or to a following image supporting material.

In attempting to solve this problem, materials such as fluorine-containing polymers and silicone polymers, which have good releasability because of their relatively low surface free energy, have been proposed for use as the surface material of the heat fixing roller. For example, heat fixing rollers having a fluorine-containing polymer surface have been disclosed for use in so-called "oil-less" fixing methods in which the heat fixing roller does not require oil as a releasing agent.

Specific examples include:

(1) a heat fixing roller in which a resin layer containing carbon fluoride in an amount of 1 to 25% is formed on a metal roller (Japanese Laid-Open Patent Application No. 57-54968);

(2) a heat fixing roller in which a layer of a fluorine-containing rubber and resin, having a content of fluorine-containing resin of 5 to 70% by weight, is formed on a metal roller (Japanese Laid-Open Patent Application No. 58-2864);

(3) a heat fixing roller in which a perfluoroalkyl silicone compound having a CF3 group at an end of the polymer molecule is formed on a metal roller (Japanese Laid-Open Patent Application No. 61-36778);

(4) a heat fixing roller having thereon a complex plating layer containing fine particles having lubricating and releasing properties (Japanese Laid-Open Patent Application No. 61-205966);

(5) a heat fixing roller in which a fluorine-containing silicone compound is layered onto a roller substrate (Japanese Laid-Open Patent Application No. 4-273276); and (6) a heat fixing roller in which tetrafluoroethylene/perfluoroalkyl vinyl ether copolymer (PFA) resin having a CF3 group at an end of the polymer molecule is layered onto a roller substrate (Japanese Laid-Open Patent Application No. 5-72934).

However, these heat fixing rollers have, for example, the following disadvantages:

(1) hot-offset often occurs at relatively low fixing temperatures of less than 150° C., depending on the surface condition of the heat fixing rollers; and (2) a fixable temperature range, which represents the difference between a minimum toner fixing temperature and a minimum temperature below which hot-offset occurs, is often too narrow to be controlled by a conventional fixing unit. Therefore these heat fixing rollers are not practical to use.

In addition, methods for preventing hot-offset have been proposed, in which a physical property of the surface of a heat fixing roller is specified to obtain good releasability. The methods include:

(1) a heat fixing roller whose surface has a center-line average roughness of greater than 0.5 $\mu$m (Japanese Laid-Open Patent Application No. 62-168182); and (2) a heat fixing roller whose surface has a ten-point mean roughness of 1 to 100 $\mu$m and a mean peak-to-peak length of 1 to 100 $\mu$m (Japanese Laid-Open Patent Application No. 64-29882).

However, these specified physical properties are measured in the absence of heat and pressure, so that these specified physical properties are not correlative with the adhesive and release properties of toner to a surface of a fixing roller when heat and pressure are applied thereto. Therefore, hot-offset is not solved by using these fixing rollers.

Further, a material having a relatively low static contact angle has been proposed for use in a heat fixing roller. However, the dynamic aspects of toner transfer in a heat fixing process is not correlative to merely a single factor of the static contact angle.

Furthermore, various constructionally improved fixing units have also been proposed, such as:

(1) a heat fixing method in which fixed toner is released from a fixing unit after cooling (Japanese Laid-Open Patent Application No. 5-341672); and (2) a heat fixing method that uses a heat fixing roller and a pressure roller pressing the heat fixing roller, in which the heat fixing roller is rotated when the temperature of the heat fixing roller is lower than a specified temperature to avoid an uneven temperature distribution in the heat fixing roller (Japanese Laid-Open Patent Application No. 7-92851).

These constructional improvements to the fixing unit require modification of the entire image forming apparatus, which results in an increase in the manufacturing cost of the image forming apparatus.

Recently, the heat energy used for fixing has decreased because of the desire for high speed fixing for high speed recording and also to save heat energy. Accordingly, toner is required to have good adhesion to a recording material even at a relatively low fixing temperature. Therefore, the toner has to include a tacky resin having a relatively low softening point in order to have good thermosensitivity. However, this also results in the toner adhering to the surface of a heat fixing roller, which would normally have good releasability when used with a conventional toner having a normal fixing temperature, thus resulting in the occurrence of hot-offset.

Because of these reasons, a need exists for a toner fixing method that produces a good fixed image without hot-offset even when toner having a relatively low fixing temperature is used.

SUMMARY OF THE INVENTION

Accordingly, an object of the present invention is to provide a toner fixing method that produces a fixed image having good image qualities without hot-offset even when toner having a relatively low fixing temperature is used.

The above object and other objects of the present invention will become apparent from the following description of a toner image fixing method.

The toner image fixing method of the present invention is used with an image forming apparatus having a fixing unit including two fixing members, in which an image formed of thermofusible toner on an image supporting material is fixed by heating at a nipped section of the two fixing members. A ratio of a first adhesion constant to a second adhesion constant, $\mu_{s\text{-}b}$ (1)/$\mu_{s\text{-}b}$ (2), of the surface of the fixing member contacting the toner image is less than about 8.0, wherein the adhesion constant, $\mu_{s\text{-}b}$ (n), is represented by the following equation:

$$\mu_{s\text{-}b}(n)=(\cos\theta_b-\cos\theta_s)/\sin\theta_b, \quad \text{(Equation 1)}$$

wherein n is 1 or 2, $\theta_b$ and $\theta_s$ represent a receding contact angle and a static contact angle, respectively, which are measured using a liquid having a dipole moment of greater than 3.0 debye when n is 1, and which are measured using another liquid having a dipole moment of 0.0 debye when n is 2.

In another embodiment, a softening point of the toner is less than about 80° C., and the ratio of the first adhesion constant to the second adhesion constant, $\mu_{s\text{-}b}$ (1)/$\mu_{s\text{-}b}$ (2), is less than about 5.0.

In yet another embodiment, the first adhesion constant, $\mu_{s\text{-}b}$ (1), is less than about 0.3.

In still another embodiment, the receding contact angle of the surface of the fixing member which contacts the developed toner image is greater than 30° when measured using a liquid having a dipole moment of greater than 3.0 debye.

In a further embodiment, the center-line average roughness, Ra, of the surface of the fixing member which contacts the developed toner image is less than about 3.0 $\mu$m.

These and other objects, features and advantages of the present invention will become apparent upon a consideration of the following description of preferred embodiments of the present invention in conjunction with the accompanying drawings.

DESCRIPTION OF PREFERRED EMBODIMENTS

According to the present invention, the releasability of melted toner from a surface of a fixing member is correlative with a ratio of a first adhesion constant to a second adhesion constant, $\mu_{s\text{-}b}$ (1)/$\mu_{s\text{-}b}$ (2), which are measured with two kinds of liquid having respective dipole moments of greater than 3.0 debye and 0.0 debye.

Figure 1:
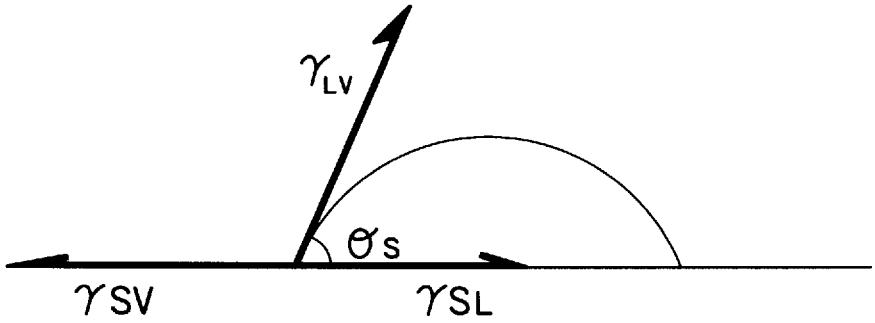
FIG. 1 is a schematic view illustrating a static tension-balanced state of three phases: solid, liquid, and vapor.

An adhesion constant is defined as follows. FIG. 1 is a schematic view illustrating a static tension-balanced state of three phases: solid, liquid, and vapor. The characters γSV, γLV, γSL, and $\theta_s$, represent an interfacial tension between the solid and the vapor, an interfacial tension between the liquid and the vapor, an interfacial tension between the solid and the liquid, and a static contact angle between the solid and the liquid, respectively. In a balanced state, the following equation is obtained:

$$\gamma SV=\gamma SL+\gamma LV\cos\theta S. \quad \text{(Equation 1a)}$$

Figure 2:
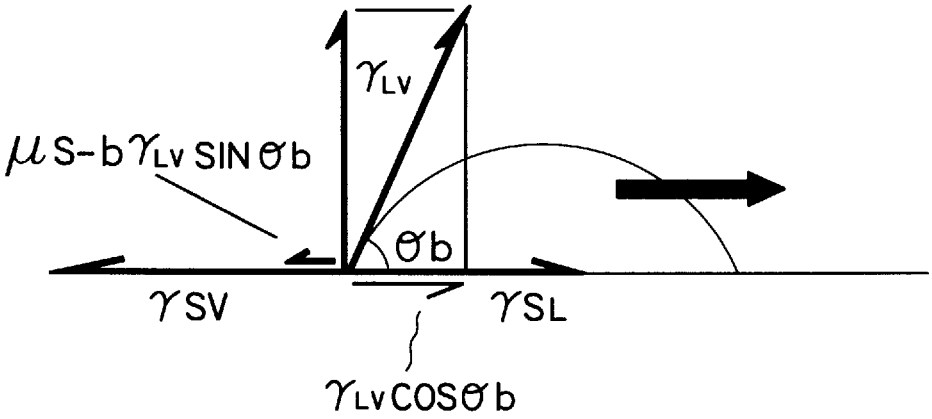
FIG. 2 is a schematic view illustrating a dynamic tension-balanced state of the solid, liquid, and vapor phases when the liquid is receding.

FIG. 2 is a schematic view illustrating a dynamic tension-balanced state of the three phases when the liquid is receding. The characters $\theta_b$ and $\mu_{s\text{-}b}$ represent a receding contact angle and an adhesion constant, respectively. The adhesion constant represents the degree of difficulty in separating the liquid from the surface of the solid. In the balanced state, the following equation is obtained:

$$\gamma SV+\mu_{s\text{-}b}\,\gamma LV\sin\theta_b=\gamma SL+\gamma LV\cos\theta_b. \quad \text{(Equation 1b)}$$

When the constants γSV, γLV, and γSL are eliminated from equations 1a and 1b, Equation 1 is obtained:

$$\mu_{s\text{-}b}=(\cos\theta_b-\cos\theta_s)/\sin\theta_b. \quad \text{(Equation 1)}$$

Therefore the degree of difficulty in separating melted toner from the surface of a fixing member may be obtained by measuring the static contact angle and the receding contact angle between the melted toner and the surface of the fixing member. However, measurements of contact angles are difficult in practice. Nevertheless, according to the present invention, the adhesion constant between melted toner and the surface of a fixing member was found to be fairly correlative with the adhesion constant measured using a liquid having a dipole moment of greater than 3.0 debye.

However, since the adhesion constant depends on surface conditions of the fixing member, the adhesion constant measured using only one kind of liquid tends to vary. By measuring the adhesion constant with two kinds of liquid having respective dipole moments of greater than 3.0 debye and 0.0 debye, factors relating to the surface conditions of the fixing member are eliminated and the ratio of the adhesion constants is found to correlate with the degree of difficulty in separating melted toner from the surface of a fixing member.

When the ratio of the first adhesion constant, which is measured using a liquid having a dipole moment of more than 3.0 debye, and the second adhesion constant, which is measured with a liquid having a dipole moment of 0.0 debye, is less than 8.0, the surface of the fixing member easily releases from the melted toner without dependence on the material of the fixing member.

On the other hand, when the ratio is greater than 8.0, hot-offset tends to occur even when the material of the fixing member is water repellent and oil repellent, such as with fluorine-containing resins.

Suitable liquids having dipole moments greater than 3.0 debye include, for example, 1-nitrobutane, 2-nitropropane, nitrobenzene, acetophenone, acetonitrile, benzonitrile, and pyridazine. The dipole moments of these liquids are shown in Table 1.

TABLE 1

| liquid | dipole moment (debye) |
|---|---|
| 1-nitrobutane | 3.29 |
| 2-nitropropane | 3.73 |
| nitrobenzene | 3.94 |
| acetophenone | 3.00 |
| acetonitrile | 3.93 |
| benzonitrile | 4.14 |
| pyridazine | 4.22 |

Suitable liquids having dipole moments of 0.0 debye include the known saturated hydrocarbons. Specific examples of saturated hydrocarbons include n-butane, n-pentane, n-hexane, n-heptane, and the like.

In an image forming apparatus having a relatively low fixing temperature, fixing unit, a softening point of the toner is preferably less than about 80° C. to maintain low temperature fixing. In this case, the ratio of the first adhesion constant to the second adhesion constant, $\mu_{s\text{-}b}$ (1)/$\mu_{s\text{-}b}$ (2), is preferably less than about 5.0 to maintain good image qualities without hot-offset. The minimum softening point of the toner useful for the low fixing temperature fixing unit is about 40° C. and preferably is about 50° C. to maintain good preservability of the toner. The softening point of the toner mostly depends on the softening point of a binder resin included in the toner. In other words, the softening point of toner is easily changed by using a proper resin for a binder resin.

Specific examples of binder resin include, but are not limited to:

homopolymers of styrene and styrene derivatives such as polystyrene, poly-p-chlorostyrene, and polyvinyltoluene;

styrene copolymers such as styrene/p-chlorostyrene, styrene/propylene, styrene/vinyltoluene, styrene/vinylnaphthalene, styrene/methyl acrylate, styrene/ethyl acrylate, styrene/butyl acrylate, styrene/octyl acrylate, styrene/methyl methacrylate, styrene/ethyl methacrylate, styrene/butyl methacrylate, styrene/a-chloromethyl methacrylate, styrene/acrylonitrile, styrene/vinyl methyl ketone, styrene/butadiene, styrene/isoprene and styrene/maleic acid;

homopolymers of (meth)acrylate and (meth)acrylate derivatives such as polymethyl methacrylate and polybutyl methacrylate;

vinyl polymers such as polyvinyl chloride and polyvinyl acetate;

polyesters; polyurethanes; polyamides; polyimides; polyols; epoxy resins; aliphatic or alicyclic polymers; and aromatic petroleum resins.

These polymers may be employed individually or in combination.

In order to obtain better hot-offset resistance, the following methods are available:

(1) decreasing the amount of electrostatic interaction, and more concretely, controlling the value of the first adhesion constant, $\mu_{s\text{-}b}$ (1), to be less than 3.0; and (2) decreasing an adhesion strength between the surface of the fixing member and the melted toner by controlling the receding contact angle to be greater than 30°, preferably greater than 40°, or decreasing the contact area between the fixing member and the melted toner by making the surface roughness of the surface of the fixing member to be less than 3.0 $\mu$m in center-line average roughness.

The material of the fixing member need not be particularly limited if the above-mentioned surface physical properties are maintained. Specific examples of materials for the fixing member which easily satisfy the above-mentioned surface physical properties include polytetrafluoroethylene, tetrafluoroethylene/perfluoroalkylvinylether (PFA) copolymer, and tetrafluoroethylene/hexafluoropropylene (FEP) copolymer, each used alone or in combination or, if desired, mixed together with a filler such as carbon fluoride, pitch fluoride or calcium fluoride, for example.

Suitable substrates for the fixing member of the present invention include the known materials. Specific examples of suitable substrates include a cylinder made of metal such as aluminum, iron, or stainless steel; a cylinder made of glass; a glass cylinder having a sheet-heater layer formed thereon; and a continuous cylindrical filmmade of a heat resistant resin such as polyimide, polyether ketone, polyether sulfone, polyether imide, and polyparabanic acid, for example.

Suitable manufacturing methods for the fixing member include but are not limited to:

(1) mixing together a resin and a solvent and, if desired, a filler to prepare a coating liquid;

(2) dispersing or dissolving the coating liquid with a conventional dispersing machine such as a supersonic dispersing machine, a stirrer, a ball mill, or a sand mill;

(3) applying the coating liquid onto a substrate by a conventional coating method such as dipping, spraying, or casting to form a surface layer thereon; and (4) drying and subjecting the coated surface layer to heat treatment.

A suitable heat treatment temperature is about 380° C. for making the surface of the surface layer smooth.

In addition, if desired, the surface of the surface layer may be subjected to a surface smoothing treatment such as abrasion or by pressing.

Further, the surface layer may be made electroconductive by including a filler or an additive in an amount that maintains the above-mentioned surface physical properties of the present invention.

Specific examples of the filler and the additive include carbon black, electroconductive whiskers, fine metal powders, organic electroconductive agents, and the like.

Other suitable methods of making a surface layer with the aforementioned surface physical properties of the present invention include:

(1) subjecting the surface of the surface layer to a fluorination treatment with a fluorinating agent;

(2) coating a fluorine-containing surface treating agent onto the surface of the surface layer; and (3) orienting fluorine atoms or fluorine-containing groups on the surface of the surface layer.

Furthermore, since the specified properties of the present invention are applied to the surface of the fixing member, a primer layer or an elastic layer can be formed without restraint between the surface layer and the substrate of the fixing member to strongly adhere the surface layer to the substrate or to securely bring the fixing member into contact with a formed toner image on a supporting material.

Having generally described this invention, a further understanding can be obtained by reference to certain specific examples which are provided herein for purposes of illustration only and are not intended to be limiting. In the descriptions in the following examples, numbers are weight ratios unless otherwise specified.

EXAMPLES

Example 1

A mixture of the following compound was dispersed for 20 min. with a supersonic dispersing machine to prepare a surface layer coating liquid for a fixing member.

| | |
|---|---|
| PTFE (polytetrafluoroethylene) (J-30, manufactured by Du Pont-Mitsui Fluorochemicals Co., Ltd.) | 100 |
| distilled water | 100 |

The surface layer coating liquid was spray coated onto an aluminum cylinder having a primer layer thereon and dried for 10 min. at 110° C. so that the coating thickness after drying was about 20 $\mu$m. The material of the primer layer was 855-001 manufactured by E. I. du Pont de Nemours and Co.

Then the surface layer coated aluminum cylinder was subjected to a heat treatment for 30 min. at 400° C. under atmospheric pressure and cooled rapidly to room temperature to form the surface layer of a fixing member.

In addition, the surface of the surface layer was subjected to a smoothing treatment in which the surface layer coated aluminum cylinder was pressed to a glass plate under a pressure of about 2.5 kg/cm$^2$ while being rotated.

Thus, a fixing member having a smooth surface layer was obtained.

Example 2

The procedure for preparation of the fixing member in Example 1 was repeated except that the formulation of the surface layer coating liquid was replaced by the following formulation.

| | |
|---|---|
| PFA (tetrafluoroethylene/perfluoroalkylvinylether copolymer) (AD-2CR, manufactured by Daikin Co., Ltd.) | 100 |
| distilled water | 200 |

Example 3

The procedure for preparation of the fixing member in Example 1 was repeated except that the formulation of the surface layer was replaced by the following formulation, the primer layer was not formed, the heat treatment was carried out for 20 min. at 250° C., and the surface smoothing treatment was not carried out.

| | |
|---|---|
| fluorine-containing latex (GLS-213D, manufactured by Daikin Co., Ltd.) | 100 |
| distilled water | 200 |
| an amine-type hardener | 5 |

Example 4

The procedure for preparation of the fixing member in Example 1 was repeated except that the surface smoothing treatment was not carried out.

Example 5

An aluminum cylinder was subjected to a zincate treatment and then electroplated with nickel using a conventional method.

The nickel electroplated aluminum cylinder was then set in a closed-type reaction vessel and subjected to a fluorinating treatment for 120 min. at 200° C. in which the atmosphere of reaction vessel was fluorine gas.

Comparative Example 1

The procedure for preparation of the fixing member in Example 1 was repeated except that the formulation of the surface layer coating liquid was replaced by the following formulation and the surface smoothing treatment was not carried out.

| | |
|---|---|
| methyl phenyl silicone resin liquid (SR-2306, Dow Corning Toray Silicone Co., Ltd.) | 100 |
| toluene | 100 |

Thus a fixing member was obtained.

Comparative Example 2

The procedure for preparation of the fixing member in Example 4 was repeated except that the heat treatment was carried out for 30 min. at 300° C.

Comparative Example 3

The procedure for preparation of the fixing member in Example 2 was repeated except that the formulation of the surface layer coating liquid was replaced by the following formulation, the primer layer was not formed and the heat treatment was carried out for 60 min. at 250° C.

| | |
|---|---|
| fluorine-containing terpolylner (THV200P, manufactured by Sumitomo 3M Limited) | 100 |
| methyl ethyl ketone | 200 |
| methyl isobutyl ketone | 200 |
| an amine-type hardener | 10 |

In accordance with the following methods, each fixing member of the present invention obtained in Examples 1 to 5 and the comparative fixing member in Comparative Examples 1 to 3 was evaluated with respect to static contact angle and receding contact angle for determining first and second adhesion constants, surface roughness, and the occurrence of hot-offset.

(1) Static contact angle

A drop of each five kinds of the following contact angle measuring liquids was formed on the surface of a fixing member in an amount of about 4 mm$^3$, respectively. Each drop was then microphotograghed to measure the contact angle between the surface of the fixing member and the drop, $\theta_s$, or the static contact angle.

| sample number of the contact angle measuring liquids | material | dipole moment (debye) |
|---|---|---|
| No. 1 | 2-nitropropane | 3.73 |
| No. 2 | acetophenone | 3.00 |
| No. 3 | 1-chlorobutane | 2.05 |
| No. 4 | distilled water | 1.87 |
| No. 5 | n-heptane | 0.00 |

(2) Receding contact angle

A drop of each five kinds of the above-mentioned contact angle measuring liquid was formed on the surface of a fixing member in an amount of greater than about 30 $mm^3$, and the changing aspects of the drop were videotaped as the drop was being soaked up by a syringe. A scene in which the contact angle between the surface of the fixing member and the drop remained constant while the volume of the drop decreased was printed out in order to measure the contact angle between the surface of the fixing member and the drop, $\theta_b$, or the receding contact angle.

(3) Center-line average-roughness, Ra

The center-line average roughness, Ra, of each fixing member was measured with a Hommel Tester T1000 surface roughness tester, manufactured by Hommelwerke GmbH. The measurement unit was $\mu$m.

(4) Minimum hot-offset temperature

After installing each fixing member into a developing unit of a IMAGIO MF150™ copier (manufactured by Ricoh Co., Ltd., but with the releasing oil coating function was eliminated therefrom), images were printed at different fixing temperatures and evaluated as to whether a hot-offset image was generated. The minimum hot-offset temperature was defined as a minimum temperature for generating a hot-offset image. The fixing speed was 100 mm/sec. In addition, the toner used for the printing test has a relatively low fixing temperature. The softening point of the toner, measured with a differential thermal analyzer, was about 75° C.

The results are shown in Tables 2 and 3.

TABLE 2

| measuring | static contact angle | | | | | receding contact angle | | | | |
|---|---|---|---|---|---|---|---|---|---|---|
| liquid | No.1 | No.2 | No.3 | No.4 | No.5 | No.1 | No.2 | No.3 | No.4 | No.5 |
| Example 1 | 48 | 45 | 30 | 111 | 18 | 41 | 37 | 20 | 99 | 6 |
| Example 2 | 44 | 47 | 36 | 110 | 21 | 39 | 35 | 30 | 96 | 12 |
| Example 3 | 37 | 36 | 22 | 88 | 20 | 4 | 6 | 6 | 50 | 5 |
| Example 4 | 46 | 38 | 29 | 116 | 17 | 31 | 31 | 20 | 94 | 5 |
| Example 5 | 36 | 33 | 32 | 98 | 20 | 34 | 32 | 15 | 80 | 18 |
| Comparative Example 1 | 36 | 37 | 16 | 95 | 5 | 8 | 9 | 9 | 86 | 5 |
| Comparative Example 2 | 44 | 30 | 24 | 150 | 17 | 9 | 3 | 10 | 75 | 9 |
| Comparative Example 3 | 13 | 12 | 6 | 98 | 4 | 3 | 3 | 6 | 80 | 3 |

TABLE 3

| measuring | ahesion constant | | | | | adhesion constant ratio (No.1/ | Ra | minimum hot-offset tempera- |
|---|---|---|---|---|---|---|---|---|
| liquid | No.1 | No.2 | No.3 | No.4 | No.5 | No.5) | ($\mu$m) | ture (°C.) |
| Example 1 | 0.13 | 0.15 | 0.22 | 0.20 | 0.42 | 0.31 | 2.71 | 200 |
| Example 2 | 0.09 | 0.24 | 0.11 | 0.24 | 0.21 | 0.43 | 2.85 | 195 |
| Example 3 | 2.85 | 1.77 | 0.64 | 0.79 | 0.65 | 4.38 | 3.01 | 185 |
| Example 4 | 0.32 | 0.13 | 0.19 | 0.37 | 0.46 | 0.70 | 3.95 | 190 |
| Example 5 | 0.04 | 0.02 | 0.46 | 0.32 | 0.04 | 1.00 | 0.42 | 195 |
| Comparative Example 1 | 1.30 | 1.21 | 0.17 | 0.16 | 0.00 | $+\infty$ | 1.45 | 165 |
| Comparative Example 2 | 1.72 | 2.53 | 0.41 | 1.16 | 0.20 | 8.60 | 2.63 | 170 |
| Comparative Example 3 | 0.46 | 0.39 | 0.00 | 0.32 | 0.02 | 23.00 | 0.56 | 160 |

As shown in the Tables 2 and 3, the fixing members of the present invention that have a ratio of first adhesion constant to second adhesion constant less than 8.0 have a high minimum hot-offset temperature that is greater than 185° C. relative to the minimum hot-offset temperatures of the comparative fixing members even when toner having a relatively low fixing temperature is employed.

In addition, it is also clearly observed from the Table 3 that the ratio of the first adhesive constant to the second adhesive constant is inversely related to the mimimum hot-offset temperature.

Obviously, additional modifications and variations of the present invention are possible in light of the above teachings. It is therefore to be understood that within the scope of the appended claims, the invention may be practiced otherwise than as specially described herein.

This application is based on Japanese Patent Application No. 08-048387 filed on Feb. 09, 1996, the entire contents of which are herein incorporated by reference.

What is claimed is:

1. A toner image fixing method comprising the steps of:

providing a thermofusible toner image on an image supporting material;

providing two fixing members with a nipped section thereof;

heating the nipped section of the two fixing members; and fixing the thermofusible toner image on the image supporting material by contacting the thermofusible toner image with the heated nipped section of the two fixing members, wherein an adhesion constant $\mu_{s\text{-}b}(n)$ is represented by:

$$\mu_{s\text{-}b}(n)=(\cos\theta_b-\cos\theta_s)/\sin\theta_b,$$

where n is 1 or 2, $\theta_b$ is a receding constant angle of a surface of at least one of the fixing members that contacts the thermofusible toner image on the image supporting material, and $\theta_s$ is a static contact angle of the surface, the receding and static contact angles determined using a liquid having a dipole moment of greater than about 3.0 debye when n is 1 and using another liquid having a dipole moment of 0.0 debye when n is 2, and a ratio of a first adhesion constant to a second adhesion constant, $\mu_{s\text{-}b}(1)/\mu_{s\text{-}b}(2)$, of the surface that contacts the thermofusible toner image on the image supporting material is less than about 8.0.

2. The toner image fixing method of claim 1, wherein the thermofusible toner has softening point of less than bout 80° C., and the ratio of the first adhesion constant to the second adhesion constant, $\mu_{s\text{-}b}(1)/\mu_{s\text{-}b}(2)$, is less than 5.0.

3. The toner image fixing method of claim 1, wherein the first adhesion constant, $\mu_{s\text{-}b}(1)$, is less than about 0.3.

4. The toner image fixing method of claim 2, wherein the first adhesion constant, $\mu_{s\text{-}b}(1)$, is less than about 0.3.

5. The toner image fixing method of claim 1, wherein the receding contact angle of the surface that contacts the thermofusible toner image is greater than about 30° when determined using a liquid having a dipole moment of greater than about 3.0 debye.

6. The toner image fixing method of claim 2, wherein the receding contact angle of the surface that contacts the thermofusible toner image is greater than about 30° when determined using a liquid having a dipole moment of greater than about 3.0 debye.

7. The toner image fixing method of claim 3, wherein the receding contact angle of the surface that contacts the thermofusible toner image is greater than about 30° when determined using a liquid having a dipole moment of greater than about 3.0 debye.

8. The toner image fixing method of claim 4, wherein the receding contact angle of the surface that contacts the thermofusible toner image is greater than about 30° when determined using a liquid having a dipole moment of greater than about 3.0 debye.

9. The toner image fixing method of claim 1, wherein the surface of the fixing member has a center-line average roughness less than about 3.0 $\mu$m.

10. The toner image fixing method of claim 2, wherein the surface of the fixing member has a center-line average roughness less than about 3.0 $\mu$m.

11. The toner image fixing method of claim 3, wherein the surface of the fixing member has a center-line average roughness less than about 3.0 $\mu$m.

12. The toner image fixing method of claim 4, wherein the surface of the fixing member has a center-line average roughness less than about 3.0 $\mu$m.

13. The toner image fixing method of claim 5, wherein the surface of the fixing member has a center-line average roughness less than about 3.0 $\mu$m.

14. The toner image fixing method of claim 6, wherein the surface of the fixing member has a center-line average roughness less than about 3.0 $\mu$m.

15. The toner image fixing method of claim 7, wherein the surface of the fixing member has a center-line average roughness less than about 3.0 $\mu$m.

16. The toner image fixing method of claim 8, wherein the surface of the fixing member has a center-line average roughness less than about 3.0 $\mu$m.

* * * * *